US005611762A

United States Patent [19]

Kaye

[11] Patent Number: 5,611,762

[45] Date of Patent: Mar. 18, 1997

[54] CONVERTIBLE WORKOUT BENCH-COFFEE TABLE

[76] Inventor: John Kaye, 44 9 Mile Rd., NW., Rte. 2, Comstock Park, Mich. 49321

[21] Appl. No.: 538,135

[22] Filed: Oct. 2, 1995

[51] Int. Cl.[6] ..... A63B 71/078

[52] U.S. Cl. ..... 482/104; 482/142; 297/119

[58] Field of Search ..... 482/104, 130, 482/133, 142; 108/13, 69, 77, 128; 297/119

[56] References Cited

U.S. PATENT DOCUMENTS

| | | | |
|---|---|---|---|
| 1,299,881 | 4/1919 | Walter | 297/119 |
| 4,609,192 | 9/1986 | Bratcher . | |
| 4,765,616 | 8/1988 | Wolff . | |
| 4,838,547 | 6/1989 | Stexling | 492/104 X |
| 5,242,345 | 9/1993 | Mitchell | 482/94 |

*Primary Examiner*—Richard J. Apley
*Assistant Examiner*—John Mulcahy

[57] ABSTRACT

The present invention relates to a workout bench-coffee table that is capable for use a both a coffee table and a workout bench. This device includes a resting portion comprising a resting portion top face and a resting portion bottom face. The resting portion top face makes up a portion of the table top when used as a coffee table, and makes up the back rest when used as a bench press. A leg frame supporting the resting portion. At least one folding side is hingedly attached to the resting portion. The folding side completes the table top when in is folded up in the horizontal position, planar to the resting portion, secured by a lock. The folding side can be folded down in an essentially vertical position, or to a position adjacent to and above the resting portion top face. A barbell support for supporting a weight is secured to the leg frame, above the resting portion. When the folding side is folded adjacent to the resting portion top face, a padding can be disposed on the folding side so the user can rest his back on a folding side padding.

5 Claims, 1 Drawing Sheet

CONVERTIBLE WORKOUT BENCH-COFFEE TABLE

BACKGROUND OF THE INVENTION

1. Field of the Invention

The present invention relates generally to both a coffee table and a workout bench, typically used for the exercise known as "bench pressing"; however, many diverse exercises can be used with most workout benches, and this invention also.

2. Description of Prior Art

Consumers who work out in their homes typically have a workout bench. And of course coffee tables are commonplace. Prior to this invention, one would have to purchase both a workout bench and a coffee table for two distinct functions; 1) working out, and 2) basic table uses, respectively. When not in use the workout bench would sit unused and taking up space, and maybe collect some dirty laundry.

There are numerous prior art workout devices and tables. However none embody the great benefit of space saving, aesthetic aura, and practicality of the present invention.

Innovations for workout benches and coffee tables have been provided in the prior art that are described as follows. Even though these innovations may be suitable for the specific individual purposes to which they address they differ from the present invention as hereinafter contrasted.

U.S. Pat. No. 4,609,192 to Bratcher discloses a collapsible table which can be set at different angles from the horizontal. This table is designed for massage. This table lacks the vertical arms necessary to hold a horizontal barbell for bench pressing and the like. U.S. Pat. No. 5,306,220 to Kearney is a frame which holds weights and barbells for various exercises, and can not be used as a coffee table. U.S. Pat. No. 5,242,345 to Mitchell is an exercise apparatus which is attached to a ceiling, and therefore does not function either as a weight bench or coffee table. U.S. Pat. No. 4,756,616 to Wolff disclose a typical workout bench, which has an adjustable incline for use as an inclined workout bench, which allows one to perform exercises at various angles.

Numerous innovations for either workout benches or coffee tables have been provided in the prior art that are adapted to be used. Even though these innovations may be suitable for the specific individual purposes to which they address, they would not be suitable for the purposes of the present invention as heretofore described.

SUMMARY OF THE INVENTION

In according with the present invention, the workout bench-coffee table consists of a resting portion, a leg frame supporting the resting portion, weight bearing means to be used during various exercises, at least one folding side, hinging means to allow the folding side to pivot about from an unfolded, essentially horizontal position to a folded, essentially vertical position, where the folding side hangs vertically about a hinging means, said hinging means also allows at least one folding side can be folded horizontal, adjacent to and above the resting portion top face, whereby the user rests their back on the folding side, which can have a padding, a locking means to allow the folding side portions to lock into the horizontal-unfolded position, allowing use as a coffee table, and a holding means disposed on the underside of the resting portion, adjacent to a resting portion bottom face, whereby the adjustable weight bearing arms can be held. The resting portion is comprised of a planar surface which can be adjustable for inclined exercises. The folding sides can fold down into a hanging vertical position, or at least one side can be folded horizontally adjacent to and above the resting portion top face, to allow the user to lie on the resting portion with each leg extending from the resting portion, feet on the ground. This allows the user to bench press while stabilizing their body with their feet.

Extending vertically upwards from either the leg frame are the weight bearing arms, which can hold a barbell.

The resting portion can be set a various inclines for additional exercises. This can be done by adjusting the entire resting portion at an incline.

When not being used for exercises, the folding sides are reset in their essentially horizontal position secured by a locking means; the weight holding arms can be held beneath the resting portion by a holding means, and now this device can be used as a coffee table in the finest of homes.

Broadly considered, the invention comprises a combination workout bench-coffee table capable of allowing essentially one item to serve many different functions, including but not limited to exercising and use as a coffee table. Accordingly, it is an object of the present invention to provide both a workout bench and coffee table.

More particularly, it is an object of the present invention to provide a household workout bench-coffee table capable of practical and quick conversion from one to the other. In keeping with these objects, and with others which will become apparent hereinafter, one feature of the present invention resides, briefly stated, in that the workout bench-coffee table is capable of use a strength training device which does not take up any extra space other than that of a coffee table.

When the workout bench-coffee table is designed in accordance with the present invention, it can provide the average consumer with an economical and effective way to own both a coffee table and workout bench without extra space or cost.

In accordance with another feature of the invention, the workout bench-coffee table allows the user to perform traditional bench pressing.

Another feature of the present invention is that the user can perform inclined bench presses by adjusting the resting portion.

Yet another feature of the present invention is that leg exercises can be performed by adding leg exercise framing.

Still another feature of the present invention is that the weight bearing means are easily removed and stored under the resting portion.

Still another feature of the present invention is that the weight bearing means can be adjusted in height whereby the height of the barbell which the weight bearing means is holding can be used for different people with different arm lengths.

Still another feature of the present invention is that the workout bench-coffee table can be fabricated from a material selected from a group consisting of plastic, plastic composites, fiberglass, plexiglass, stainless steel, epoxy, carbon-graphite, glass, tempered glass, lucite, wood, stone, metal, metal alloys and rubber composites.

The novel features which are considered characteristic for the invention are set forth in the appended claims. The invention itself, however, both as to its construction and its method of operation, together with additional objects and advantages thereof, will be best understood from the following description of the specific embodiment when read and understood in connection with the accompanying drawing.

BRIEF LIST OF REFERENCE NUMERALS UTILIZED IN THE DRAWING

EMBODIMENT ELEMENTS AND NUMBERS

100—convertible workout bench-coffee table 100
110—resting portion 110
110A—resting portion top face 110A
110B—resting portion bottom face 110B
112—folding side 112
114—adjustable weight bearing means 114
116—leg 116
118—hinging means 118
120—holding means 120
122—locking means 122
124—folding portion padding 124

DETAILED DESCRIPTION OF THE PREFERRED EMBODIMENT

Figure 1:
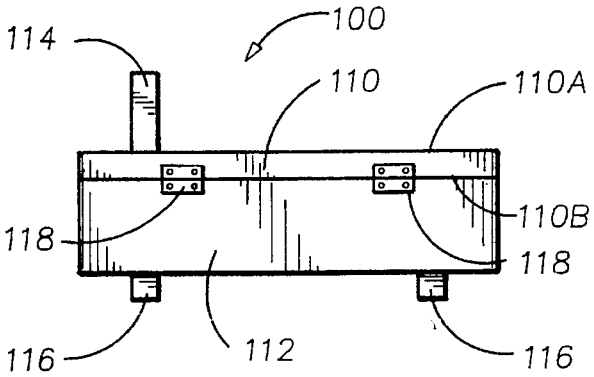
FIG. 1 is a side view of the convertible workout bench-coffee table 100 assembled, with two folding sides folded down, and weight bearing means attached.

Firstly, referring to FIG. 1 which is a side view of the convertible weight bench-coffee table 100 assembled exhibiting the following features; resting portion 110; resting portion top face 110A, which makes up the top of the coffee table and the back rest for one using the invention as a bench press; resting portion bottom face 100B, opposed the resting portion top face, folding side 112; weight bearing means 114; leg frame 116; hinging means 118, hingedly attached to both a folding side and the resting portion, allowing the folding side to pivot thereabouts; holding means 120 disposed on the resting portion bottom face to hold the weight bearing means when the invention is being used as a coffee table; locking means 122 which lock the folding side 112 in an essentially horizontal position to the resting portion 110 so the invention can be used as a coffee table and the resting portion and folding side essentially comprise one horizontal planar surface. Two folding sides 112 are shown folded down, in the essentially vertical position, folded about the hinging means 118, and the weight bearing means 114 is secured to said leg frame 116 to hold a barbell. The weight beating means height can be adjusted so as to accommodate users with different arm lengths when lifting the barbell off of the weight bearing means.

Figure 2:
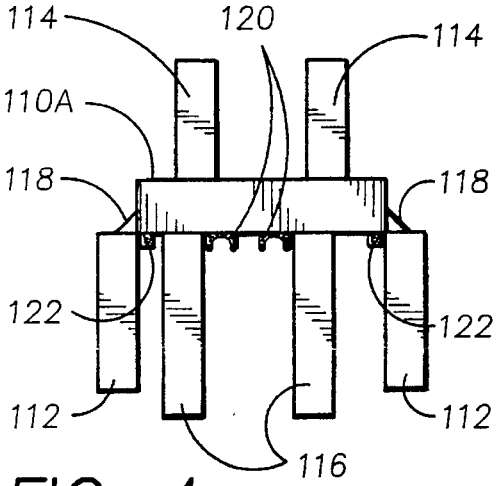
FIG. 2 is a front view of the convertible workout bench-coffee table 100 with two folding sides folded down and a weight beating means attached.

Referring to FIG. 2 which is a front view of FIG. 1.

Figure 3:
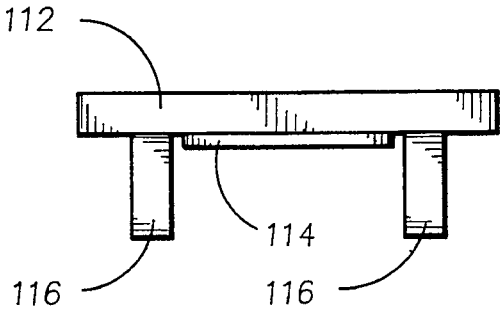
FIG. 3 is a side view of the convertible workout bench-coffee table 100 with two folding sides folded up, in the horizontal position, said folding sides secured in the horizontal position by a securing means, and the weight bearing means placed under the resting portion, adjacent to the resting portion bottom face, held by a holding means, whereby said invention can now be used as a coffee table.

Referring to FIG. 3 which is a side view of the workout bench-coffee table 100 exhibiting the following features: resting portion 110; resting portion top face 110A; resting portion bottom face 110B; folding side 112; a weight beating means 114; leg frame 116; a hinging means 118; a holding means 120; and a locking means 122. This figure shows the invention's use as a coffee table. Two folding sides 112 are locked in an essentially horizontal position by a locking means 122, the weight beating means 114 is positioned under the resting portion 110, adjacent to the resting portion bottom face 110B by a holding means 120. As the folding sides 112 are locked in an essentially horizontal position, adjacent to the resting portion 110, this increases the horizontal planar surface for use as a coffee table. The locking means 122 is disposed on the resting portion bottom side 110B of the resting portion 110.

Figure 4:
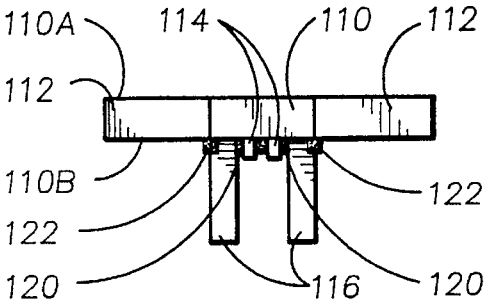
FIG. 4 is a front view of the convertible workout bench-coffee table with two folding sides folded in the horizontal position by a securing means and the weight bearing means placed under the resting portion, adjacent to the resting portion bottom face, held by a holding means, whereby said invention can now be used as a coffee table.

Referring to FIG. 4 which is a front view of FIG. 3.

The workout bench-coffee table 100 can be completely fabricated from a material selected from a group consisting of plastic, plastic composites, fiberglass, plexiglass, stainless steel, epoxy, carbon-graphite, glass, tempered glass, lucite, wood, stone, metal, metal alloys and rubber composites.

Figure 5:
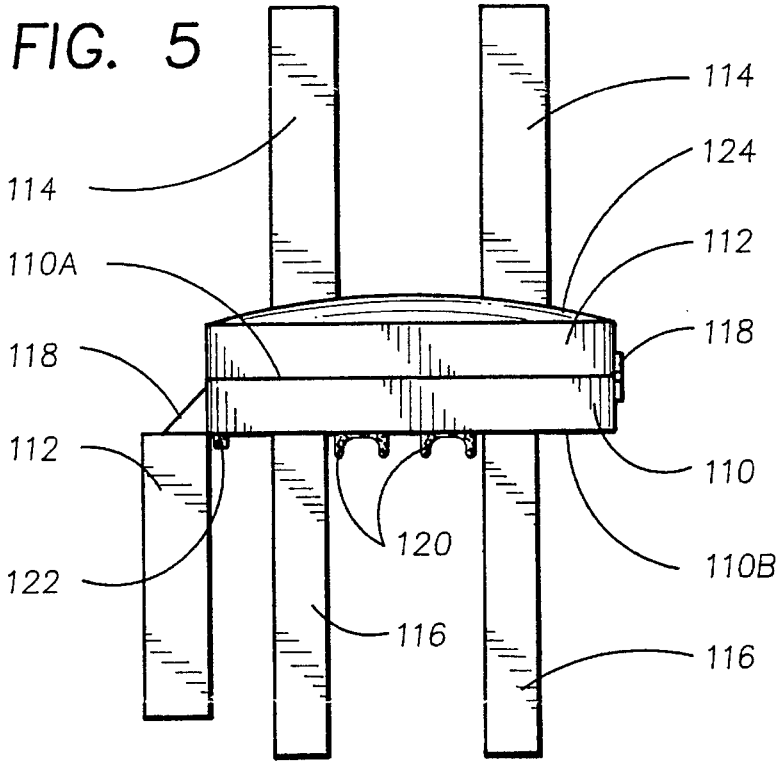
FIG. 5 is a front view of the second embodiment of the convertible workout bench-coffee table 100 with at least one folding side folded up, whereby the user rests his back against this. The other side can be folded under the resting portion, or above the resting portion, adjacent to the other folding side. The folding side can have a folding side padding, whereby the user rests his back on the padding when bench pressing.

Referring to FIG. 5 which is a front view showing at least one folding side folded onto the resting portion. A folding side padding can be affixed to the folding side whereby the user can lean on the folding side padding when in use.

It will be understood that each of the elements described above, or two or more together, may also find a useful application in other types of constructions differing from the type described above.

While the invention has been illustrated and described as embodied in a workout bench-coffee table, it is not intended to be limited to the details shown since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A workout bench-coffee table comprising;

a) a resting portion;

b) said resting portion comprising a resting portion top face, and a resting portion bottom face, said resting portion bottom face being disposed on an opposing face from said resting portion top face, whereby the resting portion top face can be used as a table top, or a back rest when performing the exercise known as bench pressing;

c) a folding side hingedly attached onto said resting portion, whereby said folding side can be moved from an essentially horizontal position on the same plane as the resting portion for use as a coffee table, and to an essentially vertical position, for use as a bench press, and can be moved horizontally, adjacent to and above the resting portion top face, whereby the user can rest their back against said folding side;

d) a leg frame supporting said resting portion;

e) a means for supporting a weight above the leg framing;

f) a means for hingedly moving said folding side from an essentially horizontal position to an essentially vertical position and to a horizontal position adjacent to and above the resting portion top face;

g) a means for holding said weight bearing means beneath said resting portion, adjacent to said resting portion bottom face;

h) a means for locking said folding side into an essentially planar horizontal position, whereby the invention can have an increased horizontal surface area for effective use as a coffee table; and i) a folding side padding disposed on said folding side whereby the user can rest his back against said folding side padding when said folding side is folded horizontally, adjacent to and above said resting portion top face.

2. The workout bench-coffee table device of claim 1, wherein the weight bearing means are two arms extending upwardly from said leg frame.

3. The workout bench-coffee table device of claim 1, wherein the hinging means are hinges adjacently attached to both said folding side and said resting portion.

4. The workout bench-coffee table device of claim 1, wherein the holding means are disposed on the resting portion bottom face and are clips which force fit around said weight bearing means.

5. The workout bench-coffee table device of claim 1, wherein the resting portion, resting portion top face, resting portion bottom face, folding side, weight bearing means, leg frame, hinging means, holding means, locking means, and folding side padding are fabricated from a material selected from a group consisting of plastic, plastic composites, fiberglass, plexiglass, stainless steel, epoxy, carbon-graphite, tempered glass, lucite, wood, stone, metal, metal alloys and rubber composites.

* * * * *